United States Patent [19]

Bundy

[11] Patent Number: 5,067,720

[45] Date of Patent: Nov. 26, 1991

[54] BOARD GAME APPARATUS

[76] Inventor: Wanda F. Bundy, 45 Susie Wilson Rd., Essex Jct., Vt. 05452

[21] Appl. No.: 663,686

[22] Filed: Mar. 4, 1991

[51] Int. Cl.[5] ..... A63F 3/00; A63F 9/18

[52] U.S. Cl. ..... 273/237; 273/288; 273/272; 273/249; 273/DIG. 24

[58] Field of Search ..... 273/237, 238, 260, 288, 273/DIG. 24, 272, 249

[56] References Cited

U.S. PATENT DOCUMENTS

| | | | |
|---|---|---|---|
| 3,948,109 | 10/1976 | Wiles | 273/237 |
| 4,121,823 | 10/1978 | McBride | 273/249 |
| 4,391,447 | 7/1983 | Dudley | 273/238 |

OTHER PUBLICATIONS

"What's the Word", Karian Corporation, 1984.

*Primary Examiner*—Benjamin Layno
*Attorney, Agent, or Firm*—Leon Gilden

[57] ABSTRACT

A board game including a printed board with a perimeter path defining a single discontinuous path, including a start and finish space. A central space of the board includes three spaces, and each space including a deck, each deck including questions to direct each player choosing a card to respond to a question regarding a synonym, an antonym, or a homonym. The path includes directional spaces to direct a player in sequence to choose a card from one of the three decks. Dice members are utilized to direct movement about the path. Each token is further provided with indicator structure to further indicate correct or incorrect responses to questions of the cards in the deck to reinforce a player's ability or inability to correctly respond to questions presented by the cards of each deck.

2 Claims, 5 Drawing Sheets

BOARD GAME APPARATUS

BACKGROUND OF THE INVENTION

1. Field of the Invention

The field of invention relates to board game apparatus, and more particularly pertains to a new and improved board game apparatus wherein the same is arranged for education and enjoyment of players for education regarding vocabulary.

2. Description of the Prior Art

Various educational board games have been utilized in the prior art. Heretofore, however, such board games have been in an elaborate or complex configuration in use wherein the board game of the instant invention is directed to players to develop their vocabulary skills regarding synonyms, antonyms, and homonyms. Vocabulary type games of the prior art are exemplified in U.S. Pat. No. 4,884,816 to Ford, et al. setting forth a thesaurus game apparatus to provide players to randomly direct answers to various questions of the board game.

U.S. Pat. No. 4,877,255 to Bon Braunhut sets forth a board game utilizing playing cards wherein cards are selected and words must be formed with cards being able to be positioned in either of a plurality of positions.

U.S. Pat. No. 4,819,945 to Porcheddu sets forth a word game apparatus wherein playing pieces of a game are formed as individual tile members and letters of the alphabet for positioning on a surface of the board game.

As such, it may be appreciated that there continues to be a need for a new and improved board game apparatus as set forth by the instant invention which addresses both the problems of ease of use as well as effectiveness in construction in enhancing development of vocabulary of players and in this respect, the present invention substantially fulfills this need.

SUMMARY OF THE INVENTION

In view of the foregoing disadvantages inherent in the known types of board game apparatus now present in the prior art, the present invention provides a board game apparatus wherein the same is arranged to direct players to responsive questions regarding understanding of words and definitions. As such, the general purpose of the present invention, which will be described subsequently in greater detail, is to provide a new and improved board game apparatus which has all the advantages of the prior art board game apparatus and none of the disadvantages.

To attain this, the present invention provides a board game including a printer board with a perimeter path defining a single discontinuous path, including a start and finish space. A central space of the board includes three spaces, and each space including a deck, each deck including questions to direct each player choosing a card to respond to a question regarding a synonym, an antonym, or a homonym. The path includes directional spaces to direct a player in sequence to choose a card from one of the three decks. Dice members are utilized to direct movement about the path. Each token is further provided with indicator structure to further indicate correct or incorrect responses to questions of the cards in the deck to reinforce a player's ability or inability to correctly respond to questions presented by the cards of each deck.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved board game apparatus which has all the advantages of the prior art board game apparatus and none of the disadvantages.

It is another object of the present invention to provide a new and improved board game apparatus which may be easily and efficiently manufactured and marketed.

It is a further object of the present invention to provide a new and improved board game apparatus which is of a durable and reliable construction.

An even further object of the present invention is to provide a new and improved board game apparatus which is susceptible of a low cost of manufacture with regard to both materials and labor, and which accordingly is then susceptible of low prices of sale to the consuming public, thereby making such board game apparatus economically available to the buying public.

Still yet another object of the present invention is to provide a new and improved board game apparatus which provides in the apparatuses and methods of the prior art some of the advantages thereof, while simultaneously overcoming some of the disadvantages normally associated therewith.

Still another object of the present invention is to provide a new and improved board game apparatus wherein the same is arranged to direct players to correctly respond and gain knowledge regarding antonyms, synonyms, and homonyms.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is an orthographic top view of the game board of section 4 as set forth in FIG. 1.

DESCRIPTION OF THE PREFERRED EMBODIMENT

Figure 1:
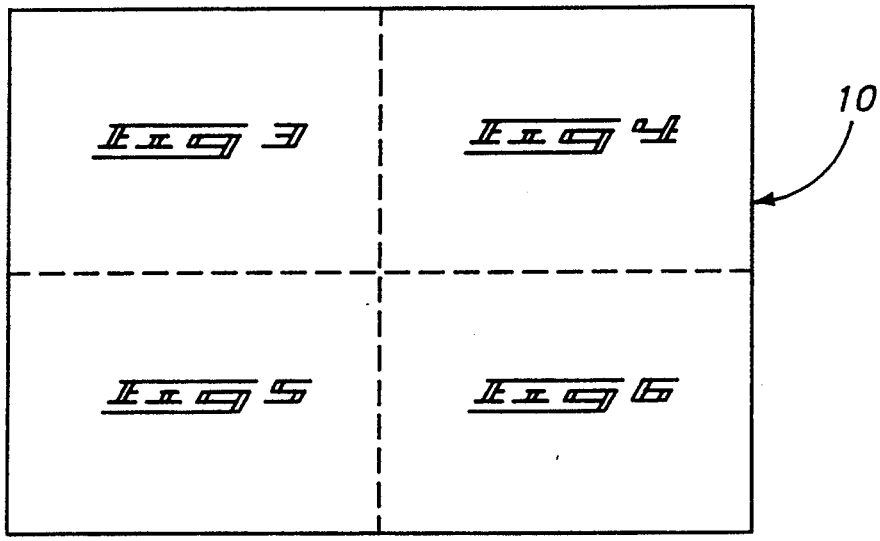
FIG. 1 is an orthographic top view, in diagrammatic illustration, of the game board utilized by the instant invention.
Figure 2:
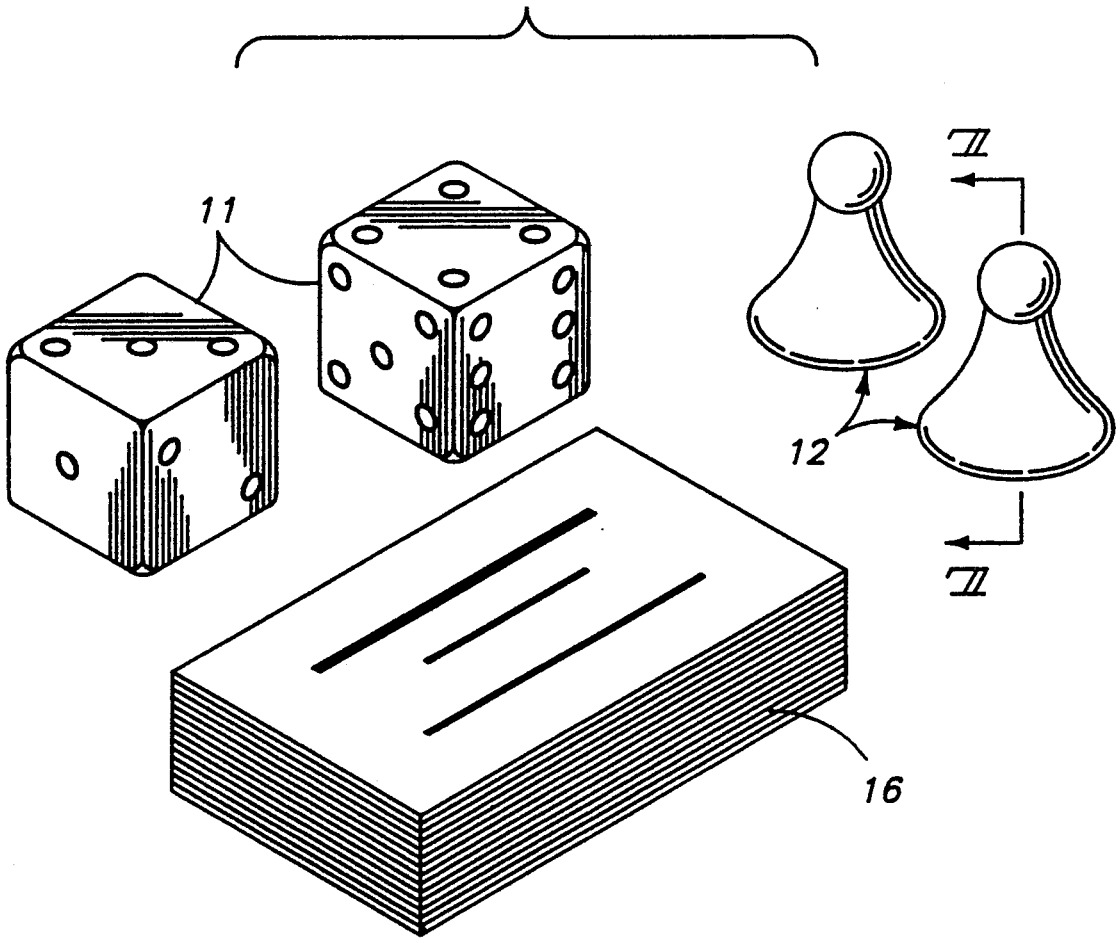
FIG. 2 is an isometric illustration of the various playing pieces utilized by the instant invention.
Figure 3:
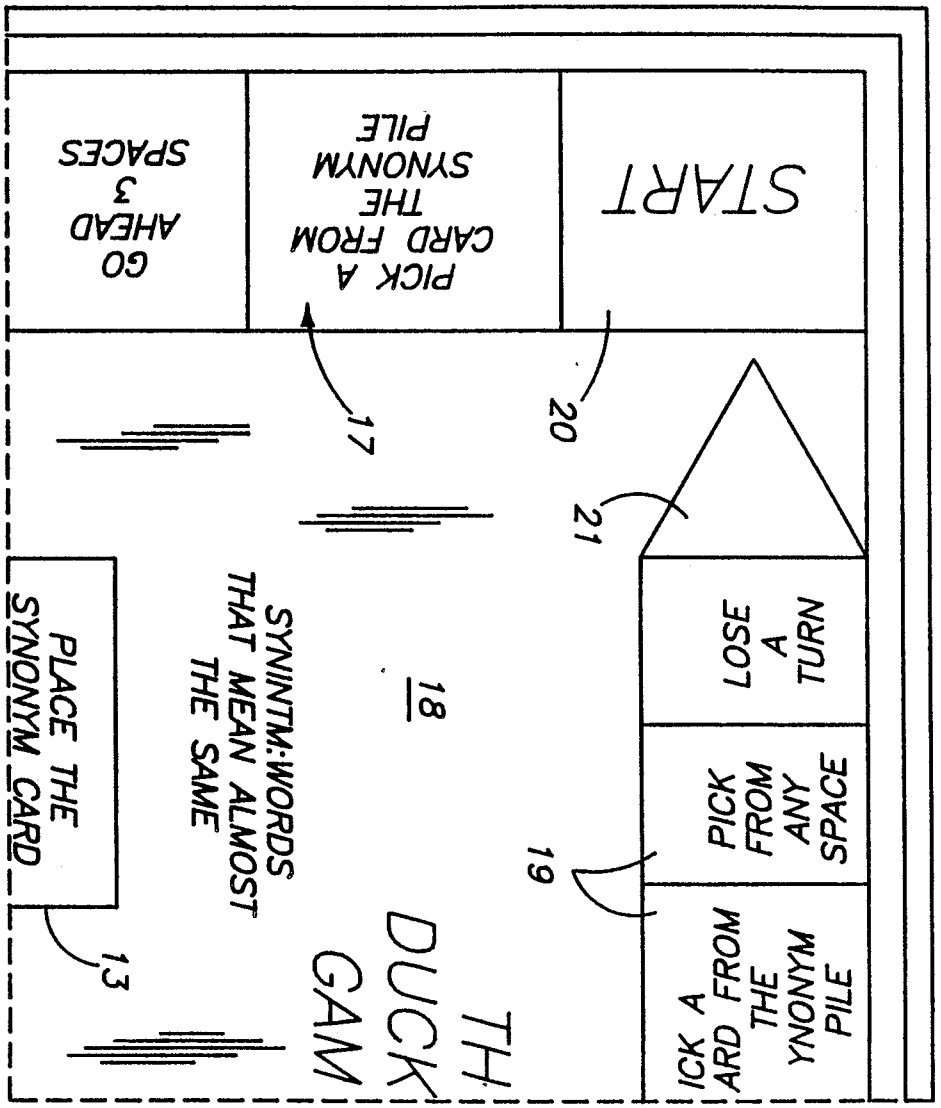
FIG. 3 is a top orthographic view of the game board of section 3 as set forth in FIG. 1.
Figure 3:
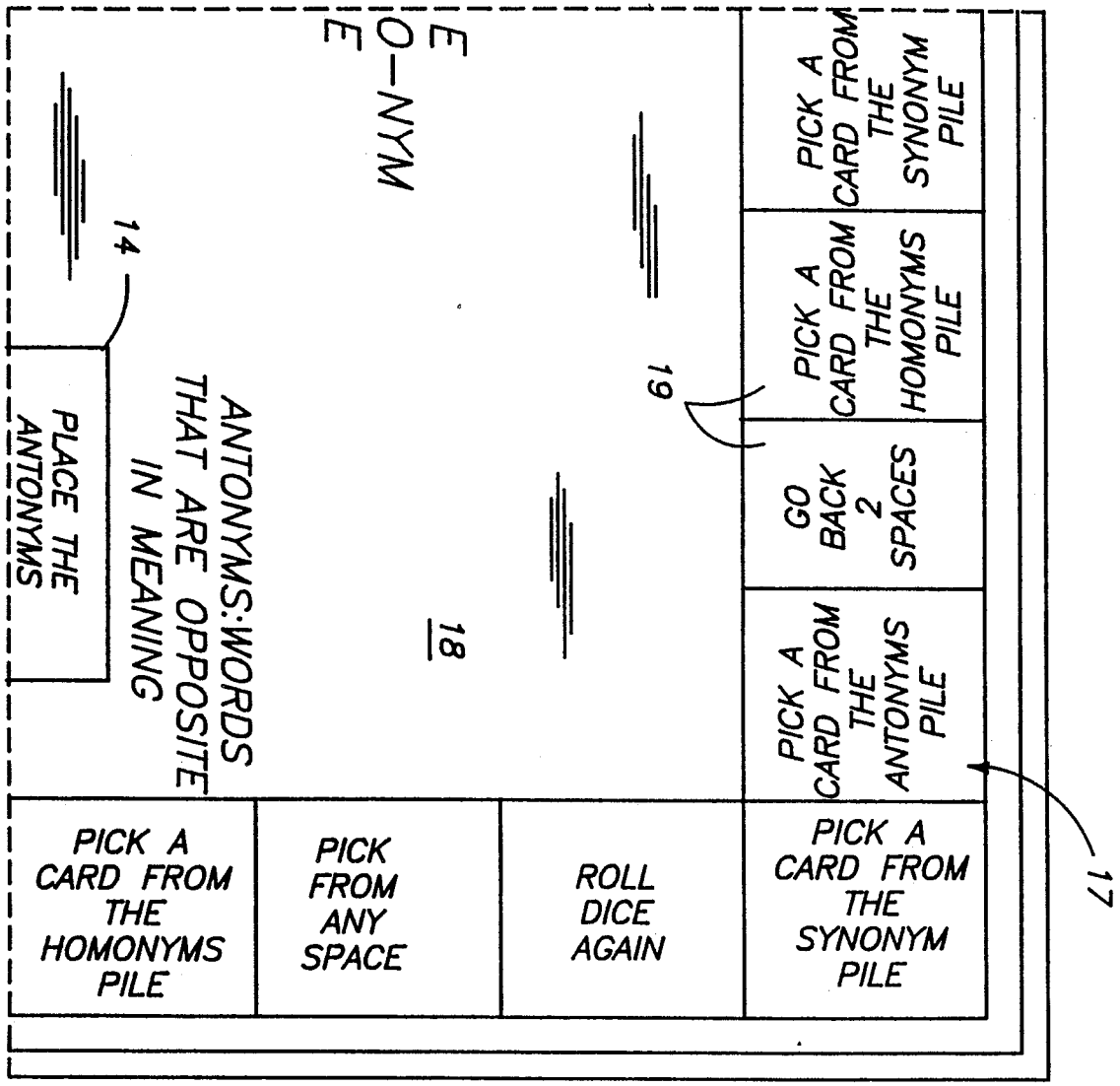
Figure 5:
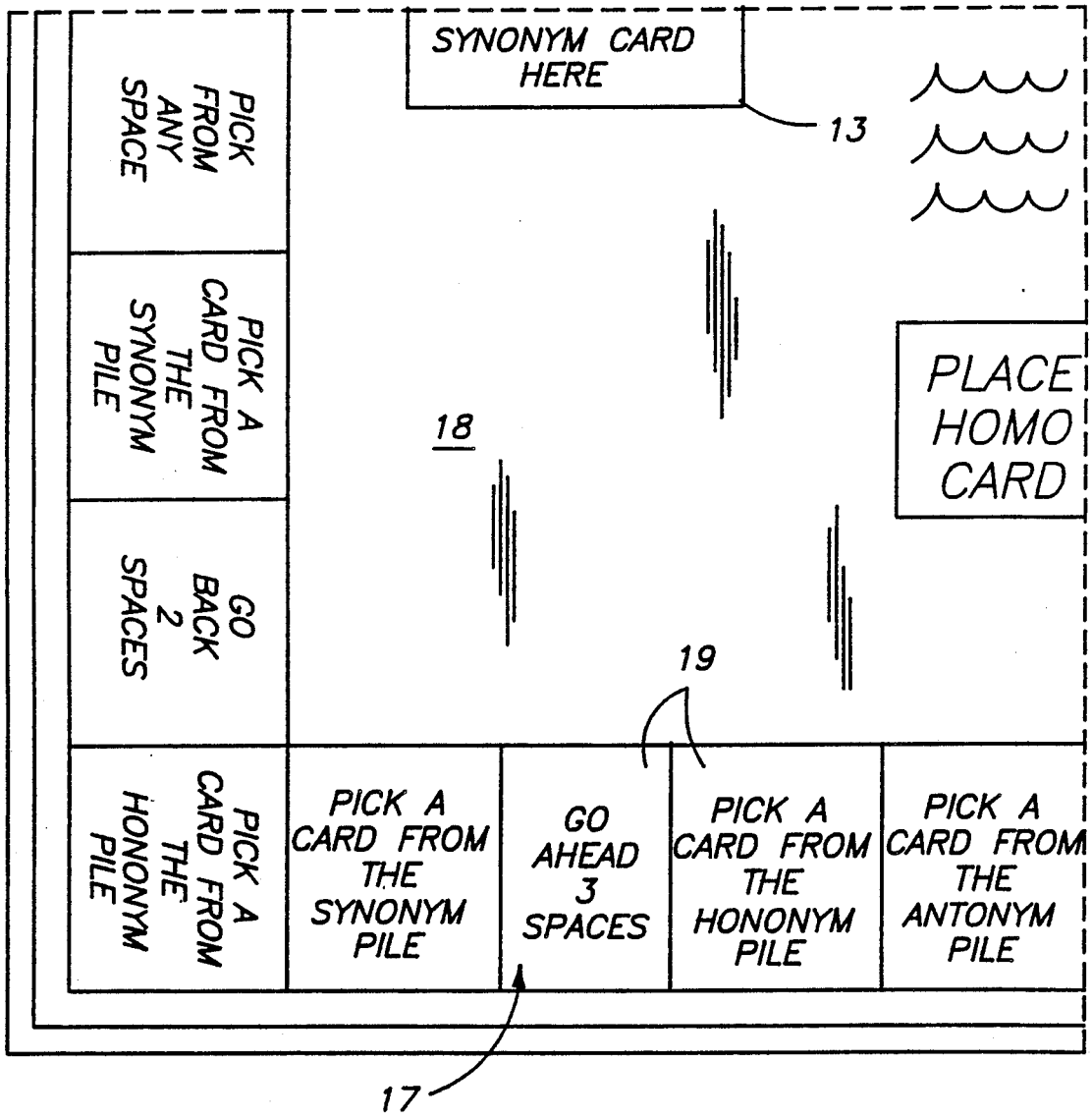
FIG. 5 is a top orthographic view of the game board as indicated by section 5 in FIG. 1.
Figure 6:
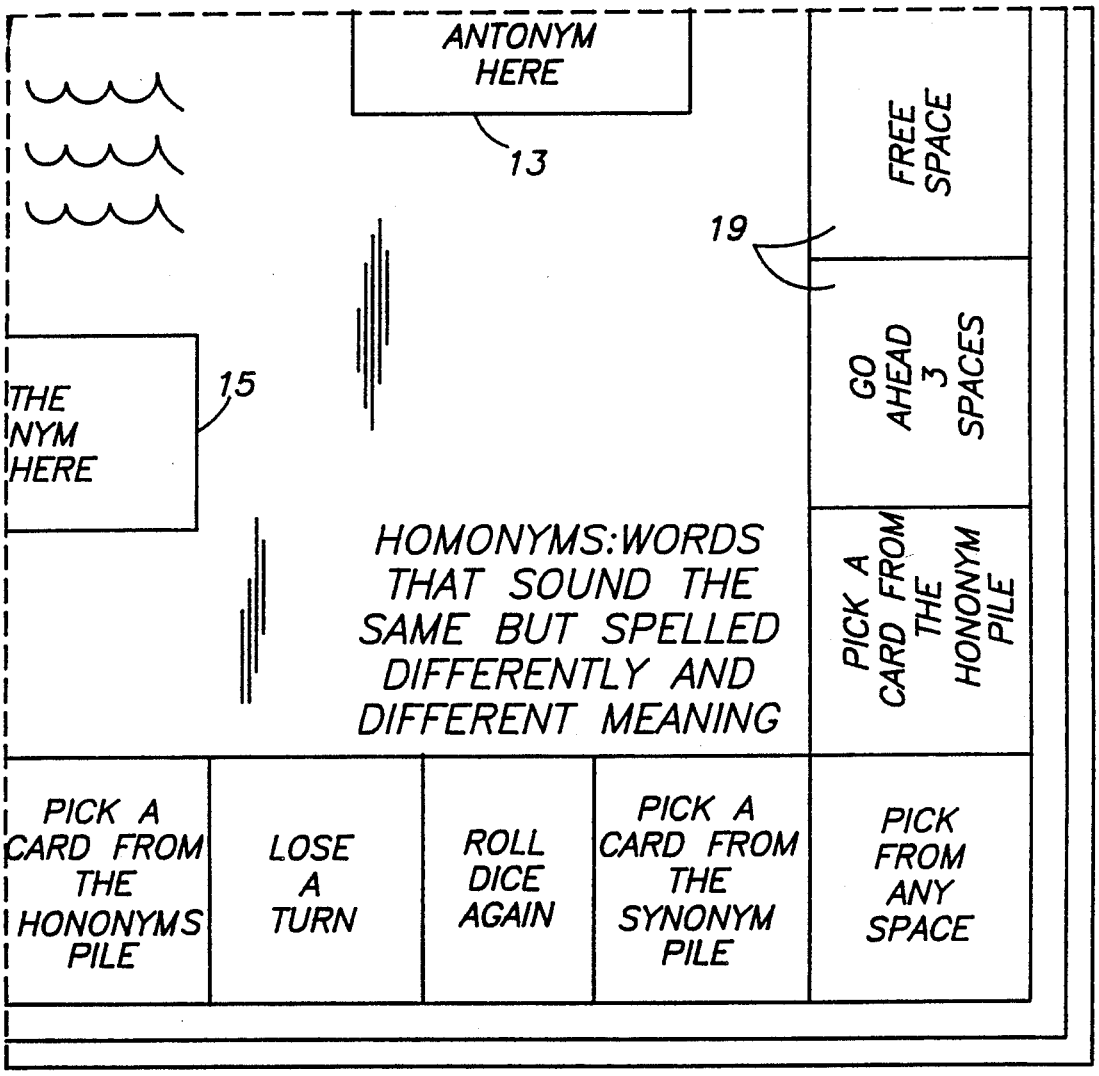
FIG. 6 is an orthographic top view of the game board as depicted in section 6 within FIG. 1.
Figure 7:
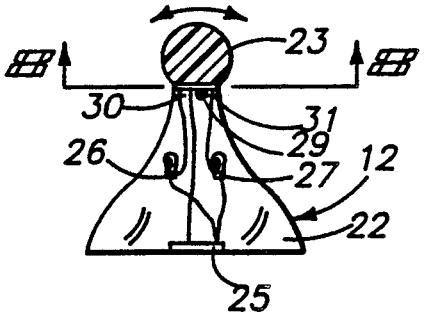
FIG. 7 is an orthographic view, taken along the lines 7—7, of a token utilized by the instant invention.
Figure 8:
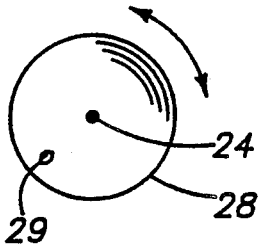
FIG. 8 is an orthographic view, taken along the lines 8—8 of FIG. 7 in the direction indicated by the arrows.

With reference now to the drawings, and in particular to FIGS. 1 to 8 thereof, a new and improved board game apparatus embodying the principles and concepts of the present invention and generally designated by the reference numeral 10 will be described.

More specifically, the board game apparatus of the instant invention essentially comprises a game board 10 defined by a planar top surface, including a discontinuous game board perimeter path 17 directed adjacent the perimeter edge of the game board, including directional spaces 19, with a start space 20 and a finish space 21 adjacent the start space. In play, a single traverse of the path 17 by an individual decides a winner upon a first player to complete traverse of the path 17. The game board includes a central space 18, including a respective first, second, and third deck space 13, 14, and 15 for positioning a respective card deck 16 within each space. Each card deck 16 is directed to questions directing a player to respond correctly discovering a respective antonym, synonym, or a homonym. A correct response entitles a player to proceed along the path 17, where incorrect responses arrest movement of a player. Within the directional spaces 19 are several spaces, such as a "free space" where a player need not respond to a question from one of the three decks within one of the respective three spaces 13–15 to maintain positioning upon that free space. In play therefore, each player in sequence rolls at least one die member of the plurality of dice 11 upon a correct response to a question presented by one of the decks 16, and that player may proceed to occupy the space directed by the rolling of the dice member. Traverse of the path 17 from the start space 20 to the adjacent finish space 21 by a player completes play of the game and declares a winner for the first player to complete such traverse of the path 17.

To reinforce and enhance correct responses by players, as well as discourage incorrect responses, each token 12 is formed with an opaque head member 23 relatively rotatable relative to a transparent base 22. The opaque head member 23 is rotatably relative to the base 22 about an axle 24 that is coincident with the axis of the base and head members. A battery 25 is mounted within the base and is cooperative with a first indicator light 26 defined by a first coloration or second indicator light 27 defined by a second coloration. An electrically conductive contact plate 28 is mounted to the bottom surface of the head 23 and includes a contact projection 29 directing downwardly and receivable within the upper surface of the base 22 to permit selective electrical communication of the contact projection 29 with a respective first or second indicator light indicator contact 30 and 31. Communication with the first indicator light contact 30 by the projection 29 completes electrical communication and illumination of the first light 26. Conversely, rotation of the contact plate 28 and contact with the projection 29 with the second indicator light electrical contact 31 effects illumination of the second indicator light 27 of the second coloration. In this manner, correct responses by a player directs a player to effect illumination of the first indicator light, wherein conversely incorrect responses directs a player to maintain illumination of the second indicator light 27, wherein each indicator light directs a contrasting coloration of the transparent base 22 to discourage incorrect response and enhance learning of vocabulary in correct response to questions of the respective card decks 16 positioned within the respective spaces 13–15.

In a like manner, the game board may be presented to direct correct responses to mathematical questions as well as questions regarding spelling of vocabulary words and the like.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A board game apparatus comprising, in combination, a game board, the game board including a top planar surface, the top planar surface including a discontinuous single path, the path defined by a series of directional spaces, and the game board including a central space positioned medially of the perimeter path, the central space including a respective first, second, and third space to receive a respective first, second, and third space to receive first, second, and third deck, each deck having cards posing predetermined questions for response by individual players, and the directional spaces directing players to select a card from a respective deck from each of the respective first, second, or third deck space, and a perimeter path including a start space and a finish space, and at least one dice member for directing movement about the perimeter path, and at least one token means for each player for indicating position of each respective player about the perimeter path, and for indicating correctness of a response relative to questions posed by the cards of the respective decks positioned within each respective first, second, and third space, wherein each token includes a transparent base, and an opaque head, the opaque head rotatably mounted relative to the transparent base, the opaque head including an axle coaxially aligned with an axis defined by the opaque head and transparent base, and a battery mounted within the transparent base, and a first indicator light defined by a first coloration positioned within the transparent base, and a second indicator light defined by a second contrasting coloration relative to the first coloration positioned within the transparent base, and contact means for selectively effecting electrical communication between the battery and said first indicator light or said second indicator light selectively.

2. An apparatus as set forth in claim 1 wherein said contact means includes an electric conductive contact plate mounted to a bottom surface of the opaque head orthogonally relative to the axle, and the transparent base including a first indicator light contact and a second indicator light contact, wherein the contact plate includes a contact projection, and wherein the contact projection is arranged for selective electrical communication with a first indicator light or the second indicator light contact to effect selective illumination of the first indicator light or the second indicator light.

* * * * *